US007133010B2

(12) United States Patent
Kim et al.

(10) Patent No.: US 7,133,010 B2
(45) Date of Patent: Nov. 7, 2006

(54) METHOD AND APPARATUS FOR DATA-DRIVING ELECTRO-LUMINESCENCE DISPLAY PANEL DEVICE

(75) Inventors: Chang Yeon Kim, Seoul (KR); Han Sang Lee, Kyounggi-do (KR); Myung Ho Lee, Kyunggi-do (KR); Joon Kyu Park, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 441 days.

(21) Appl. No.: 10/606,925

(22) Filed: Jun. 27, 2003

(65) Prior Publication Data

US 2004/0080471 A1 Apr. 29, 2004

(30) Foreign Application Priority Data

Aug. 28, 2002 (KR) ..... 10-2002-0051087

(51) Int. Cl.
*G09G 3/30* (2006.01)

(52) U.S. Cl. ..... 345/76; 315/169.3

(58) Field of Classification Search ..... 345/76–80, 345/204; 315/169.3
See application file for complete search history.

(56) References Cited

U.S. PATENT DOCUMENTS 6,756,951 B1 * 6/2004 Ishizuka et al. ..... 345/82
2002/0195967 A1 * 12/2002 Kim et al. ..... 315/169.3

FOREIGN PATENT DOCUMENTS

JP 2001-42827 2/2001

* cited by examiner

*Primary Examiner*—Amr A. Awad
*Assistant Examiner*—Stephen Sherman
(74) *Attorney, Agent, or Firm*—Morgan, Lewis & Bockius, LLP

(57) ABSTRACT

A data-driving apparatus of an electro-luminescence display panel includes a display panel receiving a current signal to display an image, and a data driver having a plurality of current sink data drive parts in order to supply data to the display panel based on a constant current, wherein the current sink data drive part comprises a current sink data drive integrated circuit for supplying the data to the display panel based on the constant current, and a reference current supply/path part for supplying the constant current to the current sink data drive integrated circuit and, at a same time, supplying the same constant current to an adjacent current sink data driver in a cascade circuit configuration.

23 Claims, 14 Drawing Sheets

METHOD AND APPARATUS FOR DATA-DRIVING ELECTRO-LUMINESCENCE DISPLAY PANEL DEVICE

The present invention claims the benefit of Korean Patent Application No. P2002-51087 filed in Korea on Aug. 28, 2002, which is hereby incorporated by reference.

BACKGROUND OF THE INVENTION

1. Field of the Invention

The present invention relates to a display panel device, and more particularly to a method and apparatus for data-driving an electro-luminescence display panel device.

2. Description of the Related Art

Currently, various flat panel displays are being developed to have reduced weight and overall size to replace cathode ray tube (CRT) devices. These flat panel displays include liquid crystal display (LCD) devices, field emission display (FED) devices, plasma display panel (PDP) devices, and electro-luminescence display (ELD) devices. Accordingly, these flat panel display devices can be classified into voltage drive devices and current drive devices.

The ELD devices are self-luminous, wherein fluorescent materials emit light by re-combining electrons with holes. The ELD devices have fast response speeds, as compared to CRT devices and passive-type luminous devices that require separate light sources, such as the LCD devices. The ELD devices may be considered current drive-type and voltage drive-type, and can generally be classified into inorganic ELD and organic ELD devices in accordance with their materials and structures.

FIG. 1 is a schematic cross sectional view of an organic electro-luminescence display device according to the related art. In FIG. 1, an organic ELD device includes an electron injection layer 4, an electron transport layer 6, a light emission layer 8, a hole transport layer 10, and a hole injection layer 12 that are deposited between a cathode 2 and an anode 14. If a voltage is supplied between the anode electrode 14 of a transparent electrode material and the cathode electrode 2 of a metal electrode material, electrons generated from the cathode 2 move toward the light emission layer 8 through the electron injection layer 4 and the electron transport layer 6. Furthermore, holes generated from the anode 14 move toward the light emission layer 8 through the hole injection layer 12 and the hole transport layer 10. Accordingly, the electrons and the holes supplied from the electron transport layer 6 and the hole transport layer 10 collide in the light emission layer 8 to re-combine, thereby generating light that is emitted through the anode 14 to an exterior to display an image. A luminous brightness of the ELD device is not proportional to a voltage supplied to both ends of the device, but is proportional to a supply current. Thus, the anode 14 is normally connected to a constant current source.

FIG. 2 is a schematic plan view of an active matrix-type electro-luminescence display device according to the related art. In FIG. 2, an active matrix-type ELD device includes an ELD panel 16 having a pixel 22 arranged at each intersection part of scan lines SL and data lines DL, a scan driver 18 to drive the scan lines SL, and a data driver 20 to drive the data lines DL. Each of the pixels 22 are selected when scan pulses are supplied to the scan line SL of a cathode to generate light corresponding to a pixel signal, i.e., a current signal supplied to the data line DL of anode. The pixels 22 include an electro-luminescence (OEL) cell and a cell driver. Each OEL cell may be equivalently expressed as a diode connected between the data line DL and the scan line SL, wherein each OEL cell emits light when a negative scan pulse is supplied to the scan line SL and a positive current is simultaneously supplied to the data line DL in accordance with a data signal, thereby supplying a forward voltage. Alternatively, a reverse voltage is supplied to the OEL cell included in an unselected scan line, whereby no light is emitted. In other words, the light-emitting OEL cell is charged with a forward charge, whereas the OEL cell with no light emission is charged with a reverse charge.

The scan driver 18 sequentially supplies the negative scan pulse to scan lines SL, and the data driver 20 supplies a current signal to the data lines DL, wherein the current signal has a current level or pulse width corresponding to a data signal for each horizontal period. Accordingly, the ELD device supplies the current signal with the current level or pulse width proportional to input data to the OEL cell, and each OEL cell emits light in proportion to the amount of current applied from the data line DL.

FIG. 3 is a schematic circuit diagram of a data driver shown in FIG. 2 according to the related art. The data driver 20 controls the pulse width of the current signal in response to the input data, and includes a plurality of data drive integrated circuits (ICs) and a data drive IC 21, which mainly uses a current mirror circuit in order to create a constant current.

In FIG. 3, the data driver IC 21 includes a reference MOSFET M0 connected between a voltage source VDD and a ground voltage source, wherein the constant current sources, i.e., constant current supply MOSFETs M1 to M4 that are connected to the voltage source VDD and, at the same time, connected in parallel to the reference MOSFET M0, form a current mirror circuit for supplying the constant current (i) to each data line connected to the OEL cell 24. In addition, the data drive IC 21 includes switch devices S1 to S4 that are connected between the constant current supply MOSFET M1 to M4 and the data line to control a supply time of the constant current (i) from the constant supply MOSFET M1 to M4 in response to the input data, thereby controlling the pulse width of the current signal. Accordingly, it is possible for the data drive IC 21 not to include the switch devices S1 to S4.

Each of the constant current supply MOSFETs M1 to M4 together with the reference MOSFET M0 receive the supply voltage of the voltage source VDD in parallel to form a current mirror circuit with the reference MOSFET M0. Accordingly, the same amount of constant current (i) or $2^n$ times the constant current, i.e., 2*i*, 4*i*, 8*i*, . . . , is supplied. The constant current (i) supplied from the constant current supply MOSFETs M1 to M4 changes in accordance with the amount of load, i.e., line resistance, of the data lines and capacitance that are both related to the amount of light emission of the OEL cell 24 due to the structure of the ELD panel. Accordingly, the data drive IC 21 includes a plurality of current control resistors each having resistance values different from each other in order to control the changing current in accordance with the amount of load. In addition, a resistor is selected among the plurality of current control resistors in accordance with an average amount of load of the data drive IC 21 to be connected between the reference MOSFET M0 and ground, thereby controlling the constant current (i) of the data drive IC 21.

The data driver 20 includes a plurality of data drive IC's 21, as shown in FIG. 3. In addition, another reference current source to the external voltage source is required for each data drive IC 21 to supply the reference current to the reference MOSFET M0. Accordingly, the output of each reference current source needs to be equal in order to reduce the current output deviation between the data drive IC's 21. Thus, each data drive IC 21 uses the same external voltage source VDD, and each current source needs to be adjusted for equalizing the reference current.

However, the active matrix-type ELD device has its own problems. For example, when the number of reference current sources increases, more operational time is required to adjust the reference current sources when a plurality of data drive IC's 21 are used.

SUMMARY OF THE INVENTION

Accordingly, the present invention is directed to a method and apparatus for a data-driving an electro-luminescence display panel device that substantially obviates one or more of the problems due to limitations and disadvantages of the related art.

An object of the present invention is to provide a data-driving apparatus and method of an electro luminescence display panel that reduces output deviations between data drive IC's.

Another object of the present invention is to provide a data-driving apparatus and method of an electro-luminescence display panel that reduces a control time of a current source from an external voltage source.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a data-driving apparatus of an electro-luminescence display panel includes a display panel receiving a current signal to display an image, and a data driver having a plurality of current sink data drive parts in order to supply data to the display panel based on a constant current, wherein the current sink data drive part comprises a current sink data drive integrated circuit for supplying the data to the display panel based on the constant current, and a reference current supply/path part for supplying the constant current to the current sink data drive integrated circuit and, at a same time, supplying the same constant current to an adjacent current sink data driver in a cascade circuit configuration.

In another aspect, a data-driving apparatus of an electro luminescence display panel includes a display panel receiving a current signal to display an image, and a data driver having a plurality of current source data drive parts to supply data to the display panel based on a constant current, wherein the current source data drive part comprises a current source data drive integrated circuit for supplying the data to the display panel based on the constant current, and a reference current supply/path part for sup plying the constant current to the current source data drive integrated circuit and, at the same time, supplying the same constant current to an adjacent current source data driver in a cascade circuit configuration.

In another aspect, a data-driving method of an electro-luminescence display panel having a pixel formed at each intersection part of scan lines and data lines, a scan driver to control the scan lines and a data driver to control the data lines includes steps of simultaneously supplying a constant current generated by an external voltage source to a current sink data integrated circuit and an adjacent current sink data integrated circuit, which are connected in a cascade circuit configuration within the data driver, and supplying data to the data lines based on the supplied constant current.

In another aspect, a data-driving method of an electro-luminescence display panel having a pixel formed at each intersection part of scan lines and data lines, a scan driver to control the scan lines and a data driver to control the data lines includes steps of simultaneously supplying a constant current generated by an external voltage source to a current source data integrated circuit and an adjacent current source data integrated circuit, which are connected in a cascade circuit configuration within the data driver, and supplying data to the data lines based on the applied constant current.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
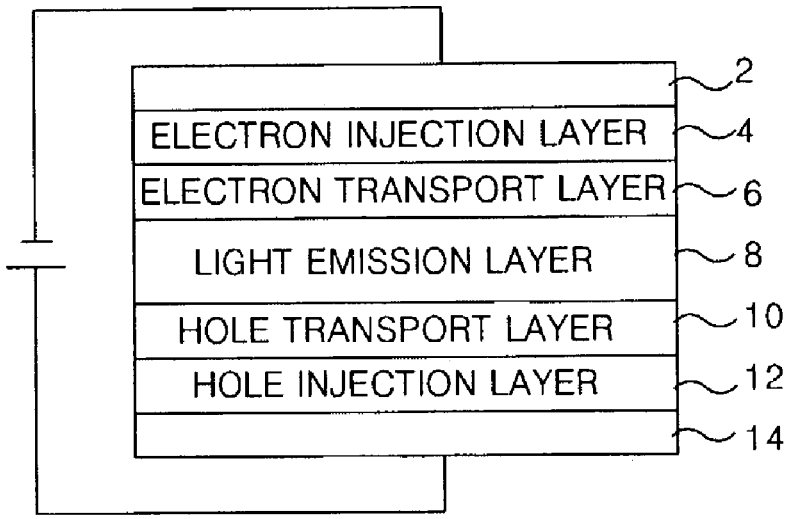
FIG.1 RELATED ART
FIG. 1 is a schematic cross sectional view of an organic electro-luminescence display device according to the related art.
Figure 2:
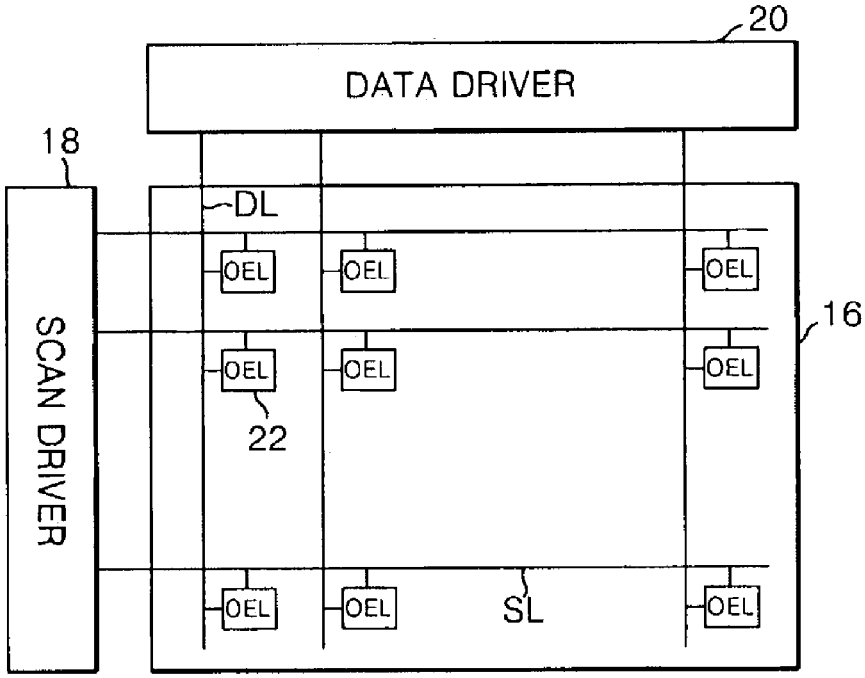
FIG.2 RELATED ART
FIG. 2 is a schematic plan view of an active matrix-type electro-luminescence display device according to the related art.
Figure 3:
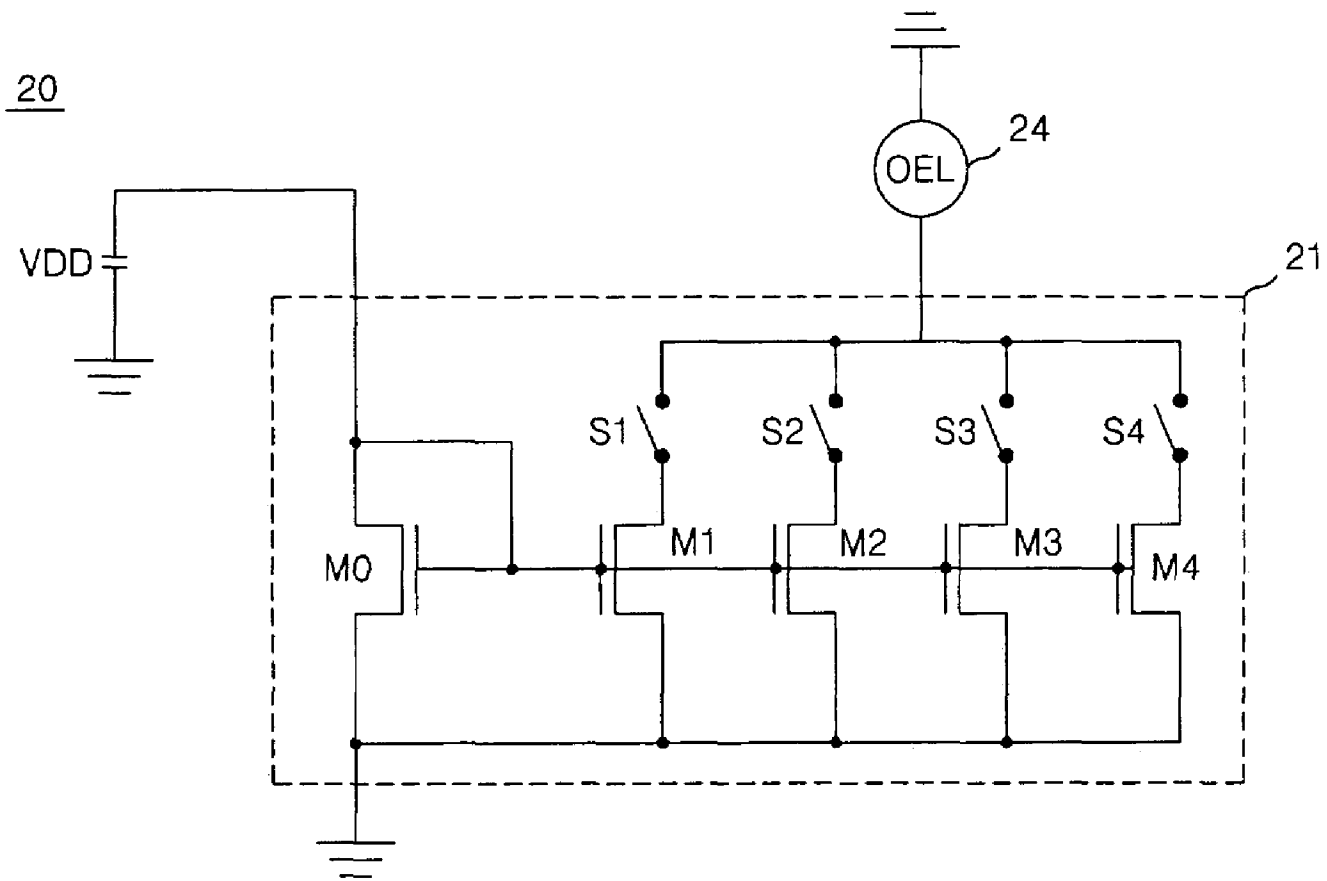
FIG. 3 RELATED ART
FIG. 3 is a schematic circuit diagram of a data driver shown in FIG. 2 according to the related art.
Figure 4:
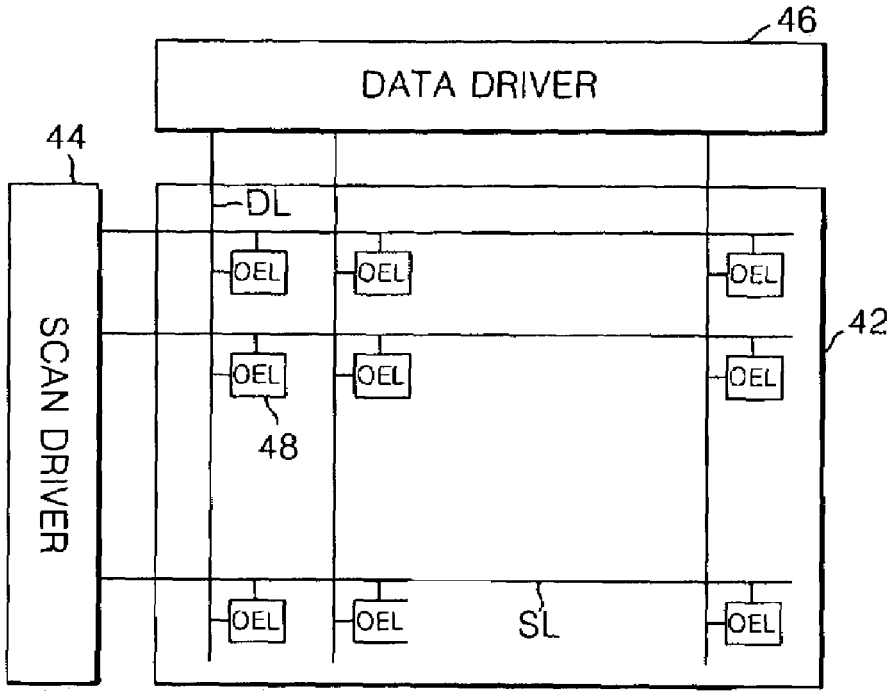
FIG. 4 is a schematic circuit diagram of an exemplary active matrix-type electro-luminescence display apparatus according to the present invention.

FIG. 4 is a schematic circuit diagram of an exemplary active matrix-type electro-luminescence display apparatus according to the present invention. In FIG. 4, an active matrix-type electro-luminescence display device may include an ELD panel 42 having a pixel 48 arranged at each intersection part of scan lines SL and data lines DL, a scan driver 44 to drive the scan lines SL, and a data driver 46 to drive the data lines DL. Each pixel 48 may be selected when scan pulses are supplied to the scan line. SL of a cathode to generate light corresponding to a pixel signal, i.e., a current signal, supplied to the data line DL of an anode.

Figure 5:
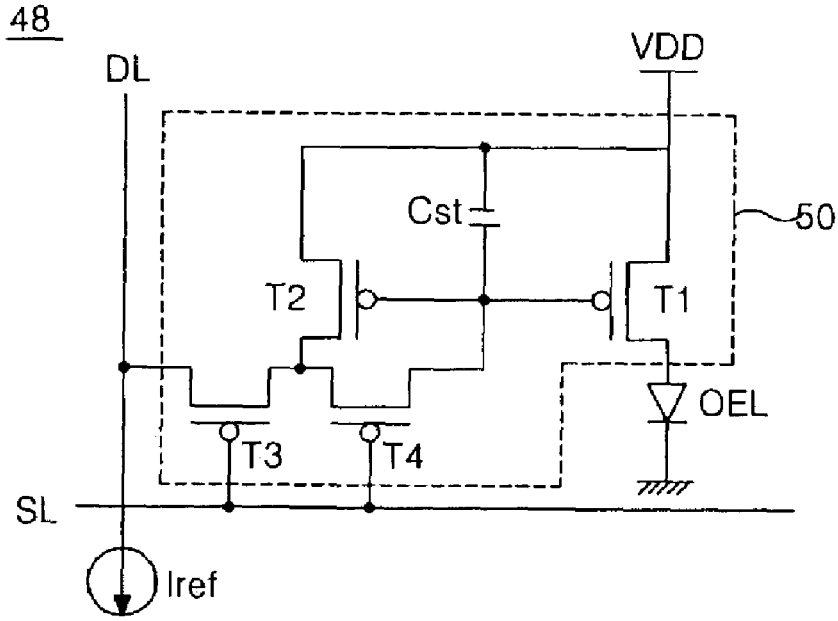
FIG. 5 is a schematic circuit diagram of an exemplary cell of an electro-luminescence display panel of FIG. 4 according to the present invention.

FIG. 5 is a schematic circuit diagram of an exemplary cell of an electro-luminescence display panel of FIG. 4 according to the present invention. In FIG. 5, each pixel 48 may include a cell driver 50 and an electro-luminescence (OEL) cell, wherein each OEL cell may be equivalently expressed as a diode connected between the data line DL and the scan line SL. Each OEL cell may emit light when a negative scan pulse is supplied to the scan line SL and, at the same time, a positive current is supplied to the data line DL in accordance with a data signal, thereby supplying a forward voltage. Conversely, a reverse voltage may be supplied to the OEL cell included in an unselected scan line, whereby no light is emitted. In other words, the light-emitting OEL cell may be charged with a forward charge, whereas the OEL cell with no light emission may be charged with a reverse charge.

The scan driver 44 may sequentially supply the negative scan pulse to scan lines SL by lines, and the data driver 46 may supply a current signal to the data lines DL, wherein the current signal has a current level or pulse width corresponding to a data signal for each horizontal period. Accordingly, the ELD device may supply the current signal with the current level or pulse width proportional to input data to the OEL cell, wherein each OEL cell may emit light in proportion to the amount of current applied from the data line DL.

In FIG. 5, the cell driver 50 may include a first TFT T1 formed between a cell drive voltage source VDD and the OEL cell for driving the OEL cell, a second TFT T2 connected to the cell drive voltage source VDD to form a current mirror with the first TFT T1, a third TFT T3 connected to the second TFT T2, the scan line SL, and the data DL for responding to a signal of the data line DL, a fourth TFT T4 connected to the gate terminals of the first TFT T1 and the second TFT T2, the scan line SL, and the third TFT T3, and a capacitor Cst connected between the cell drive voltage source VDD and the gate terminals of the first TFT T1 and the second TFT T2. For example, the first to fourth TFT T1 to T4 may include p-type MOSFETs.

The third and fourth TFT's T3 and T4 may be turned ON in response to a negative scan voltage from the scan line SL, whereby a current path may be enabled to conduct current between the source terminal and the drain terminal. In addition, the third and fourth TFT's T3 and T4 may remain at an OFF state when a voltage in the scan line SL is below the threshold voltage Vth of the third and fourth TFT's T3 and T4. A data voltage Vcl from the data line DL may be supplied to the gate terminal of the first TFT T1 through the third and fourth TFT's T3 and T4 during an ON period of time of the third and fourth TFT's T3 and T4. Conversely, each of the first and second TFT's T1 and T2 may remain open for the data voltage Vcl not to be supplied to the first TFT T1 during an OFF period of time of the first and second TFT's T1 and T2.

The first TFT T1 may control the current between the source terminal and the drain terminal by the data voltage Vcl supplied to the gate terminal of itself, wherein the OEL cell is made to emit light with a brightness corresponding to the data voltage Vcl. The second TFT T2 may be configured to form a current mirror with the first TFT T1, thereby uniformly controlling current at the first TFT T1.

The capacitor Cst may store a voltage difference between the data voltage Vcl and a cell drive voltage VDD to uniformly sustain the voltage supplied to the gate terminal of the first TFT T1 for one frame period, and to uniformly sustain the current supplied to the OEL cell for one frame period. In addition, the data driver 46 controlling the pulse width of the current signal in response to the input data may include a plurality of data drive integrated circuits (ICs).

Figure 6:
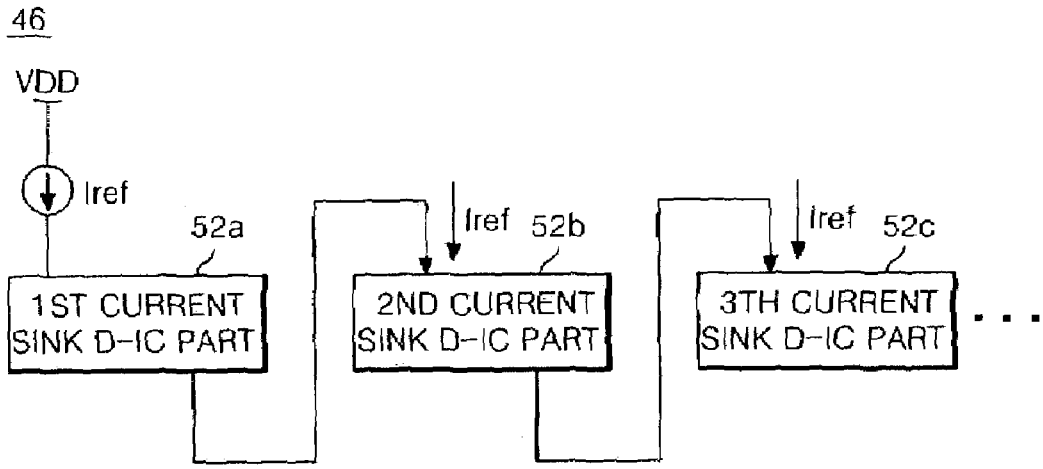
FIG. 6 is a schematic diagram of an exemplary configuration of a data driver according to the present invention.
Figure 7:
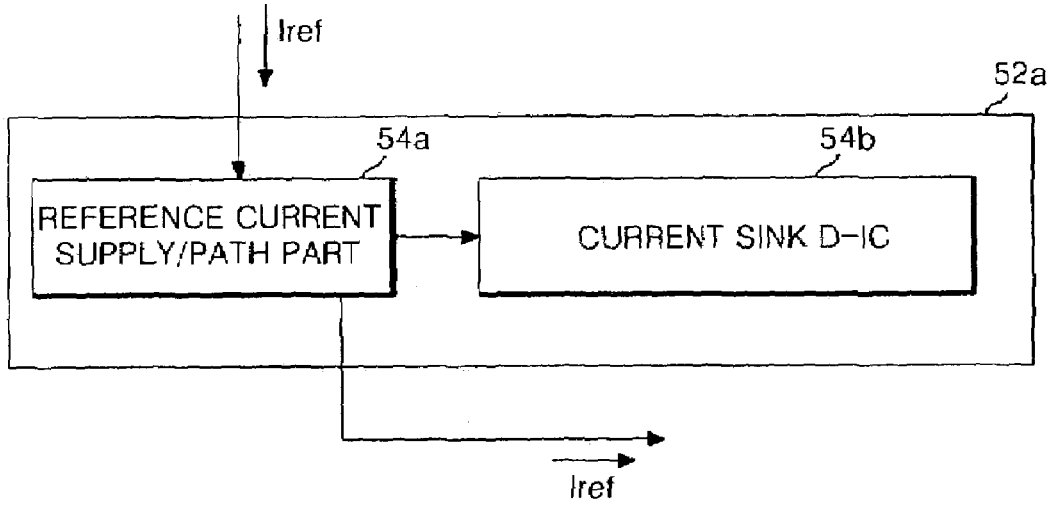
FIG. 7 is a schematic diagram of an exemplary current sink data drive IC part of FIG. 6 according to the present invention.
Figure 8:
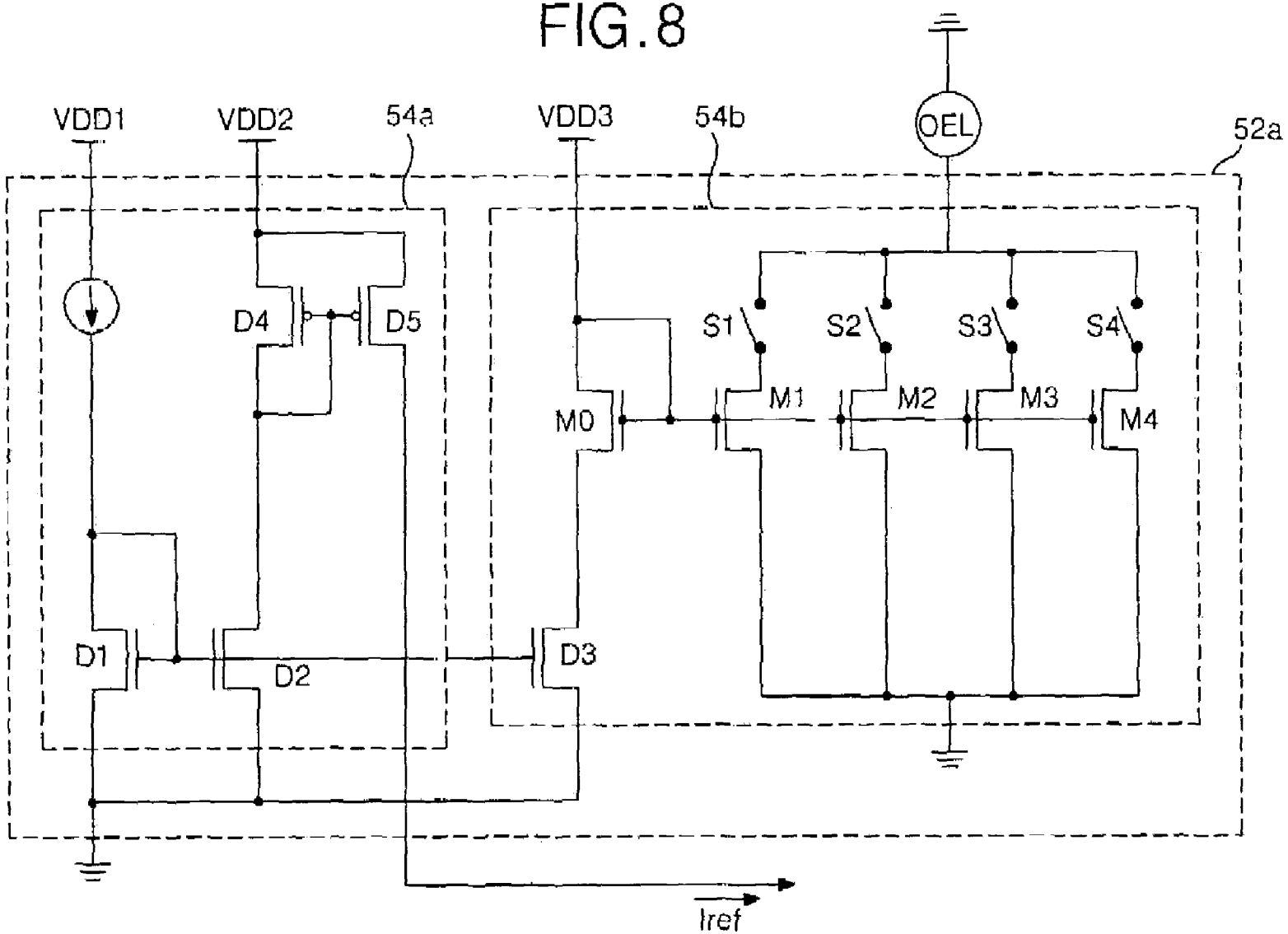
FIG. 8 is a schematic circuit diagram of the current sink data drive IC part of FIG. 6 according to the present invention.

FIG. 6 is a schematic diagram of an exemplary configuration of a data driver according to the present invention, FIG. 7 is a schematic diagram of an exemplary current sink data drive IC part of FIG. 6 according to the present invention, and FIG. 8 is a schematic circuit diagram of the current sink data drive IC part of FIG. 6 according to the present invention. In FIGS. 6 to 8, a data driver 46 may include a plurality of current sink data drive IC's 52*a*, 52*b*, 52*c*, . . . , which may be interconnected in a cascade circuit configuration. Each of the current sink data drive IC's 52*a*, 52*b*, 52*c*, . . . may include a reference current supply/path part 54*a* and a current sink data drive IC 54*b* that may be driven by a reference current from the reference current supply/path part 54*a*.

In FIG. 7, the reference current supply/path part 54*a* may receive a reference constant current Iref generated from an exterior voltage source to supply the received current to the current sink data drive IC 54*b*. In addition, the reference current supply/path part 54*a* may supply the same reference constant current (i) to an adjacent current sink data drive IC part 52*b*.

In FIG. 8, the reference current supply/path part 54*a* may include a first switching device D1 connected between a first voltage source VDD1 and a ground voltage source GND, second and third switching devices D2 and D3 connected to the ground voltage source GND to form a current mirror circuit with the first switching device D1, a fourth switching device D4 connected between the second switching device D2 and a second voltage source VDD2, and a fifth switching device D5 connected to the second voltage source VDD2 to form a current mirror circuit with the fourth switching device D4 and to transmit a reference current to the current sink data drive IC part 52*b*. In addition, the third switching device D3 may be included within the current sink data drive IC 54*b*. The first to third switching devices D1 to D3 may include n-type MOSFETs, and the fourth and fifth switching devices D4 and D5 may include p-type MOSFETs.

During operation, a reference current Iref may flow in the first switching device D1 in accordance with a current source using a first voltage source VDD1, and the same reference current Iref may flow in the second switching device D2 forming the current mirror with the first switching device D1. A current may flow in the fourth switching device D4 connected to the second voltage source VDD2 and the second switching device D2 as much as the reference current Iref flows through the second switching device D2. Accordingly, the same reference current Iref may flow in the fifth switching device D5 forming the current mirror with the fourth switching device D4, and the current may be supplied to the adjacent current sink data drive IC part 52*b*. Accordingly, the same current may be supplied to all current sink data drive IC's 54*b* within the data driver 46.

In FIG. 8, the current sink data drive IC 54*b* may include a reference MOSFET M0 connected between a third voltage source VDD3 and the third switching device D3, and constant current sources, i.e., constant current supply MOSFETs M1 to M4, connected in parallel to the reference MOSFET M0 with the voltage source VDD to form a current mirror circuit for supplying a constant current (i) to each data line connected to the OEL cell. Furthermore, the current sink data drive IC 54*b* may include switch devices S1 to S4 that are connected between each of the constant current supply MOSFETs M1 to M4 and the data line to control the supply time of the constant current (i) from the constant current supply MOSFET M1 to M4 in response to input data, thereby controlling the pulse width of the current signal. Accordingly, it may be possible for the current sink data drive IC 54*b* not to include the switch devices S1 to S4.

Each of the constant current supply MOSFETs M1 to M4 together with the reference MOSFET M0 receiving the supply voltage of the ground voltage source GND in parallel may form a current mirror circuit with the reference MOSFET M0, so the same amount of constant current (i) or $2^n$ times the constant current, i.e., 2*i*, 4*i*, 8*i*, . . . , may be supplied. The constant current (i) supplied from the constant current supply MOSFETs M1 to M4 may change in accordance with the amount of load, i.e., line resistance, of the data lines and a capacitance that is related to the amount of light emission of the OEL cell due to the structure of the ELD panel. Accordingly, the current sink data drive IC 54*b* forming a current mirror circuit may include a plurality of current control resistors with a resistance value different from each other in order to control the changing current in accordance with the amount of load. In addition, a resistor may be selected among the plurality of current control resistors in accordance with an average amount of load of the current sink data drive IC 54*b* to be connected between the reference MOSFET M0 and the ground, thereby controlling the constant current (i) of the current sink data drive IC 54*b*.

Figure 9:
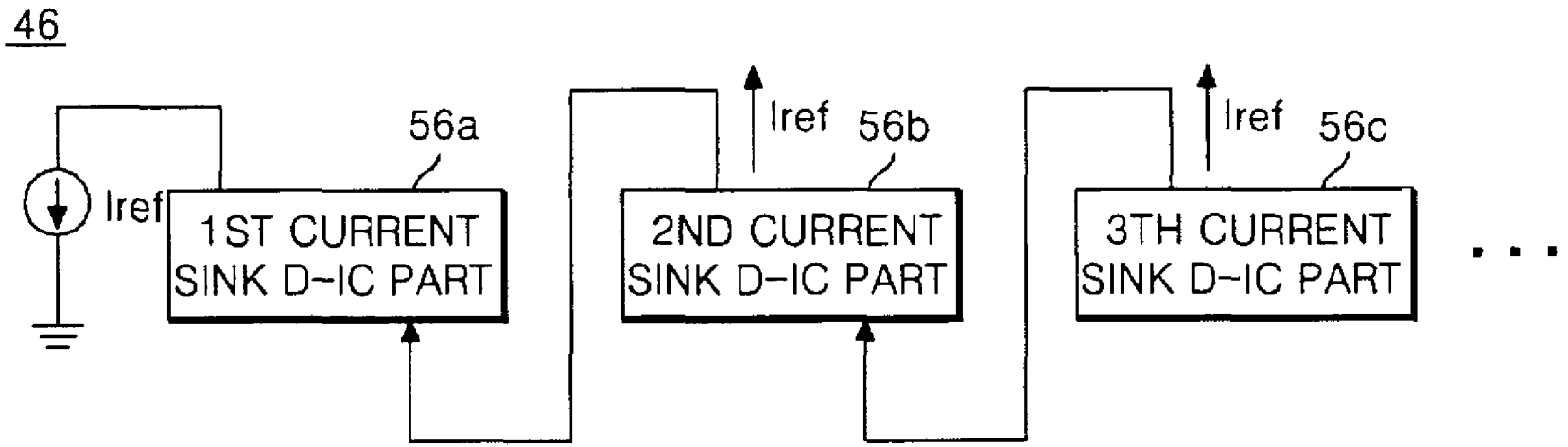
FIG. 9 is a schematic diagram of an exemplary configuration of a data driver according to the present invention.
Figure 10:
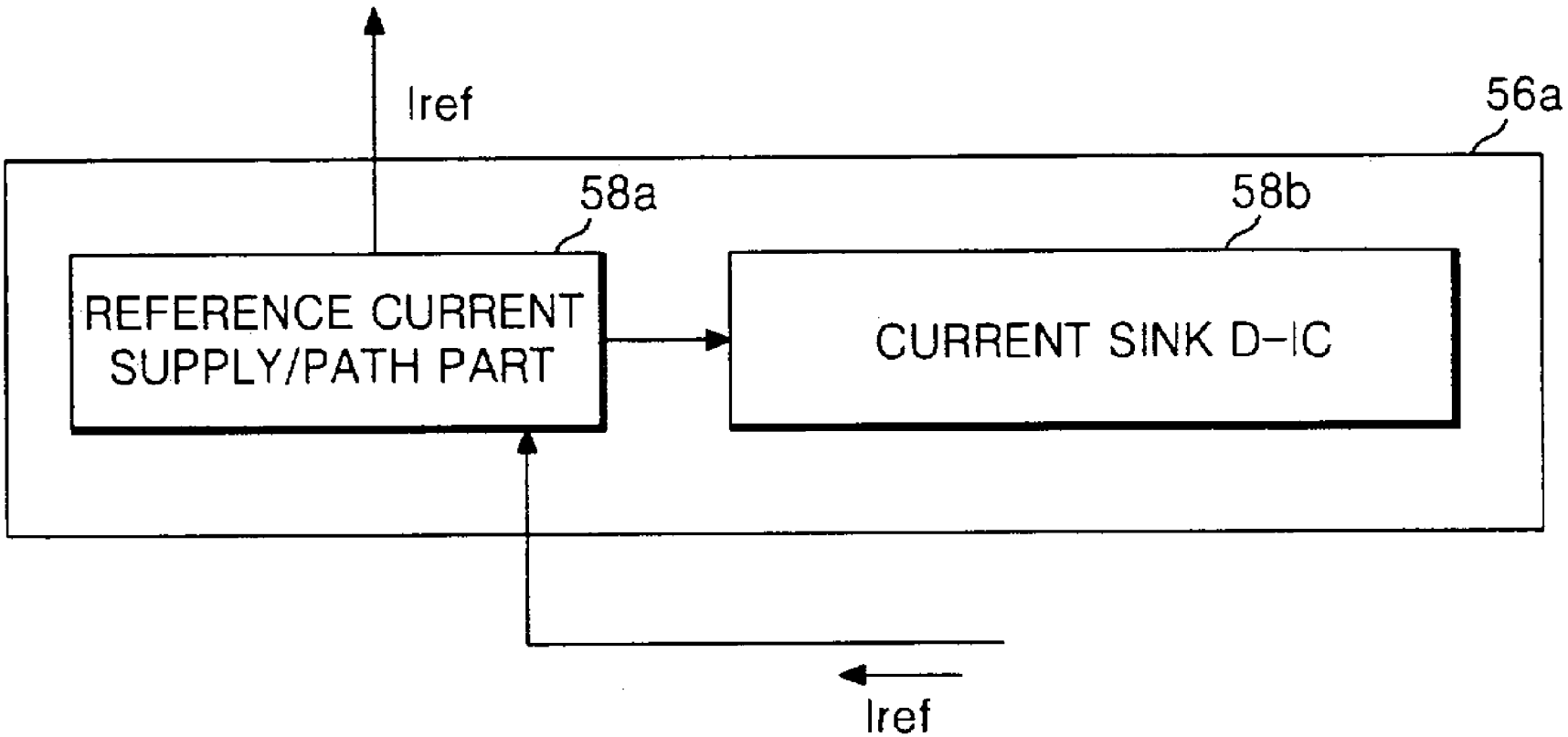
FIG. 10 is a schematic diagram of an exemplary current sink data drive IC part of FIG. 9 according to the present invention.
Figure 11:
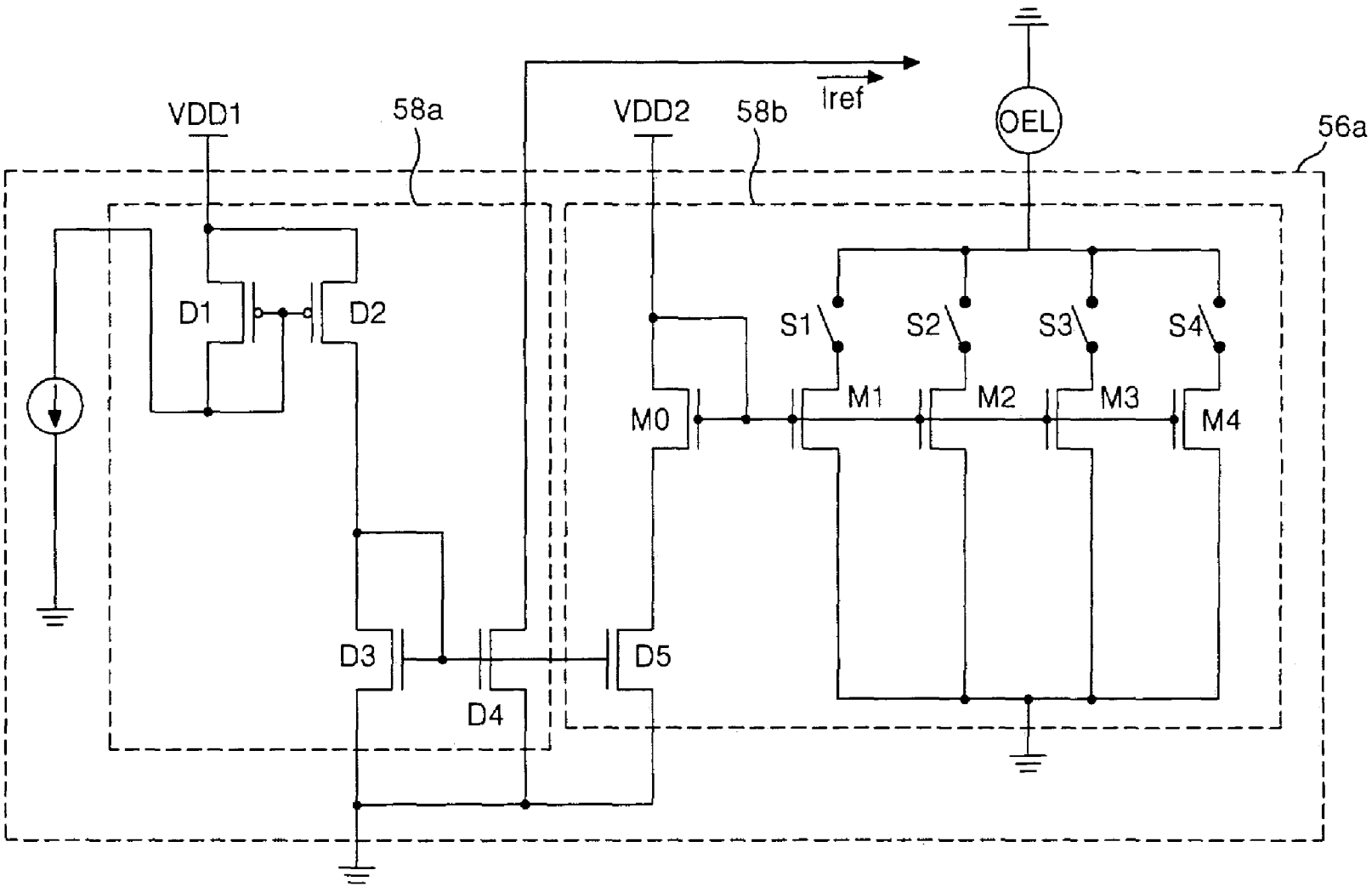
FIG. 11 is a schematic circuit diagram of the current sink data drive IC part of FIG. 9 according to the present invention.

FIG. 9 is a schematic diagram of an exemplary configuration of a data driver according to the present invention, FIG. 10 is a schematic diagram of an exemplary current sink data drive IC part of FIG. 9 according to the present invention, and FIG. 11 is a schematic circuit diagram of the current sink data drive IC part of FIG. 9 according to the present invention. In FIGS. 9 to 11, a data driver 46 may include a plurality of current sink data drive IC's 56*a*, 56*b*, 56*c*, . . . , which may be interconnected in a cascade circuit configuration. Each of the current sink data drive IC's 56*a*, 56*b*, 56*c*, . . . may include a reference current supply/path part 58*a* and a current sink data drive IC 58*b* that may be driven by a reference current from the reference current supply/path part 58*a*, as shown in FIG. 10.

In FIG. 10, the reference current supply/path part 58*a* may receive the reference constant current Iref generated from a ground voltage source to supply the received current to the current sink data drive IC 58*b*. In addition, the reference current supply/path part 58*a* may supply the same reference constant current (i) to an adjacent current sink data drive IC part 56*b*.

In FIG. 11, the reference current supply/path part 58*a* may include a first switching device D1 connected between a first voltage source VDD1 and a ground voltage source GND, a second switching device D2 connected to the first voltage source VDD1 to form a current mirror circuit with the first switching device D1, a third switching device D3 connected between the second switching device and the ground voltage source GND, a fourth switching device D4 connected to the ground voltage source GND to form a current mirror circuit with the third switching device D3 and to transmit the reference current to the adjacent current sink data drive IC part 56*b*, and a fifth switching device D5 connected to the ground voltage source GND to form a current mirror circuit with the third switching device D3 and to supply the reference current to the current sink data drive IC part 58*b*. Accordingly, the fifth switching device D5 may be included within the current sink data drive IC 58*b*. The first and second switching devices D1 and D2 may include p-type MOSFETs, and the third to fifth switching devices D3 to D5 may include n-type MOSFETs.

During operation, a reference current Iref may flow through the source-drain terminals of the first switching device D1 in accordance with a pulse width of a current signal using the ground voltage source GND, and the same reference current Iref may flow in the second switching device D2 forming the current mirror with the first switching device D1. The reference current Iref via the second switching device D2 may control the gate terminal of the third switching device D3, thereby causing the same reference current Iref to flow in the third switching device D3. Accordingly, the same reference current Iref may flow in the fourth switching device D4 that forms the current mirror circuit with the third switching device D3, and the same reference current Iref may also flow in the adjacent current sink data drive IC 56*b* connected to the fourth switching device D4. The fifth switching device D5 forming the current mirror circuit with the third switching device D3 may supply the reference current Iref into the current sink data drive IC 58*b* in the same manner as the third switching device D3. Accordingly, the same current may be supplied to all current sink data drive IC's 58*b* within the data driver 46.

The current sink data drive IC 58*b* may include a reference MOSFET M0 connected between a second voltage source VDD2 and the fifth switching device D5, and constant current sources, i.e., constant current supply MOSFETs M1 to M4, connected in parallel to the reference MOSFET M0 with the voltage source VDD to form a current mirror circuit for supplying a constant current (i) to each data line connected to the OEL cell. Furthermore, the current sink data drive IC 58*b* may include switch devices S1 to S4 that are connected between each of the constant current supply MOSFETs M1 to M4 and the data line to control a supply time of the constant current (i) from the constant current supply MOSFET M1 to M4 in response to input data, thereby controlling the pulse width of the current signal. Accordingly, it may be possible for the current sink data drive IC 58*b* not to include the switch devices S1 to S4.

Each of the constant current supply MOSFETs M1 to M4 together with the reference MOSFET M0 receiving the supply voltage of the ground voltage source GND in parallel may form a current mirror circuit with the reference MOSFET M0, so the same amount of constant current (i) or $2^n$ times the constant current, i.e., 2*i*, 4*i*, 8*i*, . . . , may be supplied. The constant current (i) supplied from the constant current supply MOSFETs M1 to M4 may change in accordance with the amount of load, i.e., line resistance, of the data lines and a capacitance that is related to the amount of light emission of the OEL cell due to the structure of the ELD panel. Accordingly, the current sink data drive IC 58*b* forming a current mirror circuit may include a plurality of current control resistors with a resistance value different from each other in order to control the changing current in accordance with the amount of load. In addition, a resistor may be selected among the plurality of current control resistors in accordance with an average amount of load of the current sink data drive IC 58*b* to be connected between the reference MOSFET M0 and the ground, thereby controlling the constant current (i) of the constant current data drive IC 58*b*.

Figure 12:
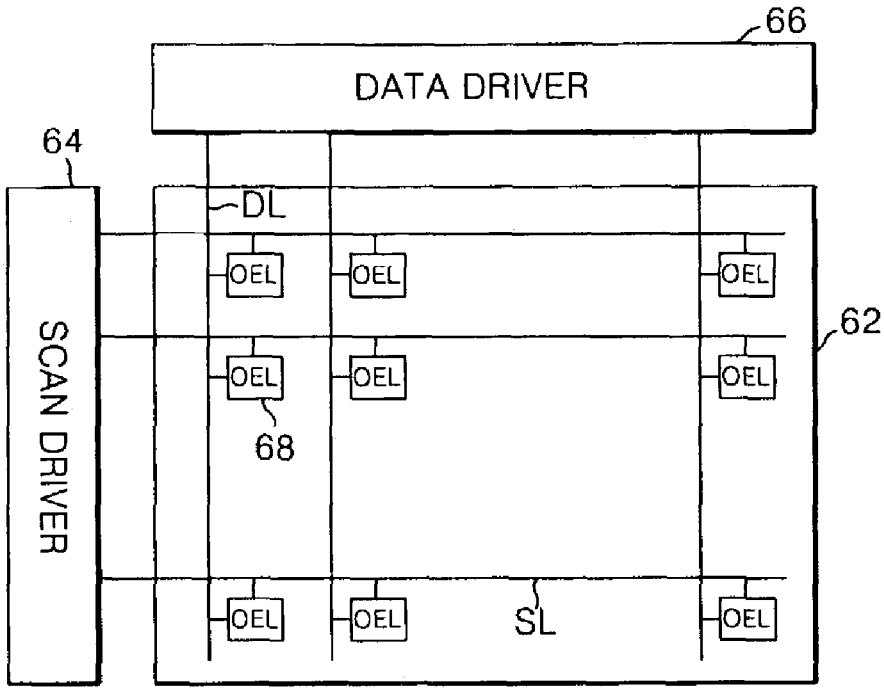
FIG. 12 is a schematic plan diagram of another exemplary active matrix-type electro-luminescence display device according to the present invention.

FIG. 12 is a schematic plan diagram of another exemplary active matrix-type electro-luminescence display device according to the present invention. In FIG. 12, an active matrix type ELD device may include an ELD panel 62 having a pixel 68 arranged at each intersection part of scan lines SL and data lines DL, a scan driver 64 to drive the scan lines SL, and a data driver 66 to drive the data lines DL.

Figure 13:
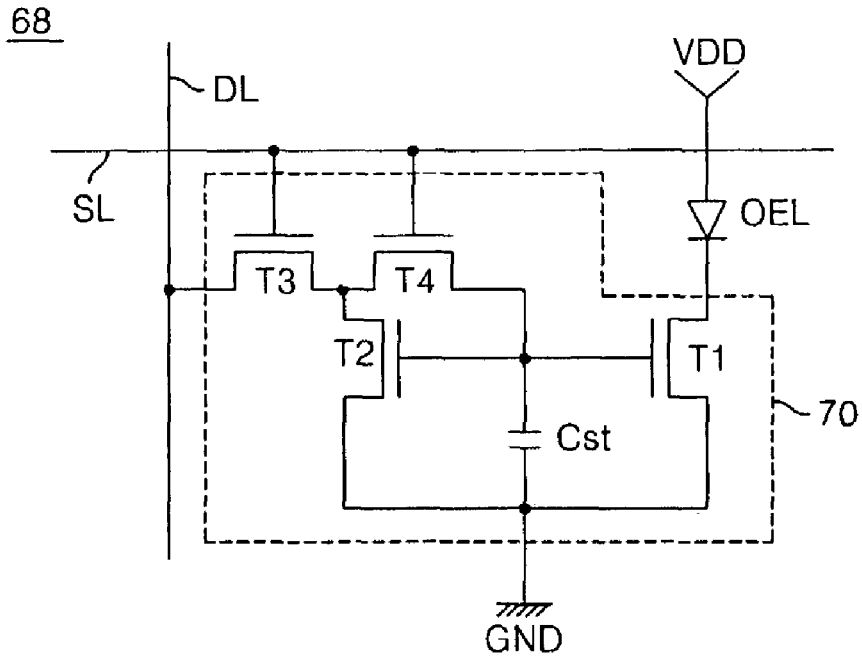
FIG. 13 is a schematic circuit diagram of an exemplary cell of an electro-luminescence display panel of FIG. 12 according to the present invention.

FIG. 13 is a schematic circuit diagram of an exemplary cell of an electro-luminescence display panel of FIG. 12 according to the present invention. In FIG. 13, each pixel may be selected when scan pulses are supplied to the scan line SL of a cathode to generate light corresponding to a pixel signal, i.e., a current signal, supplied to the data line DL of an anode. In addition, each pixel may include a cell driver 70 and an OEL cell, wherein the OEL cell may be equivalently expressed as a diode connected between the data line DL and the scan line SL. Each OEL cell may emit light when a negative scan pulse is supplied to the scan line SL and, at the same time, a positive current is supplied to the data line DL in accordance with a data signal, thereby supplying a forward voltage. Conversely, a reverse voltage may be supplied to the OEL cell included in an unselected scan line, whereby no light may be emitted. In other words, the light-emitting OEL cell may be charged with a forward charge, whereas the OEL cell with no light emission may be charged with a reverse charge.

The scan driver 64 may sequentially supply the negative scan pulse to scan lines SL by lines, and the data driver 66 may supply a current signal to the data lines DL, wherein the current signal may have a current level or pulse width corresponding to a data signal for each horizontal period. Accordingly, the ELD device may supply the current signal with the current level or pulse width proportional to input data to the OEL cell. In addition, each OEL cell may emit light in proportion to the amount of current applied from the data line DL.

In FIG. 13, the cell driver 70 may include a first TFT T1 formed between a ground voltage source GND and the OEL cell for driving the OEL cell, a second TFT T2 connected to the ground voltage source GND to form a current mirror with the first TFT T1, a third TFT T3 connected to the second TFT T2, the scan line SL, and the data DL for responding to a signal of the data line DL, a fourth TFT T4 connected to the gate terminals of the first TFT T1 and the second TFT T2, the scan line SL, and the third TFT T3, and a capacitor Cst connected between the ground voltage source GND and the gate terminals of the first TFT T1 and the second TFT T2. The first to fourth TFT T1 to T4 may include n-type MOSFETs.

The third and fourth TFT's T3 and T4 may be turned ON in response to a positive scan voltage from the scan line SL, thus a current path may be enabled to conduct current between the source terminal and the drain terminal of the third and fourth TFT's T3 and T4. In addition, the third and fourth TFT's T3 and T4 may remain at an OFF state when a voltage in the scan line SL is below the threshold voltage Vth of the third and fourth TFT's T3 and T4. A data voltage from the data line DL may be supplied to the gate terminal of the first TFT T1 through the third and fourth TFT's T3 and T4 during an ON period of time period of the third and fourth TFT's T3 and T4. Conversely, each of the first and second TFT's T1 and T2 may be open for the data voltage Vcl not to be supplied to the first TFT T1 during an OFF period of time of the first and second TFT's T1 and T2.

The first TFT T1 may control the current between the source terminal and the drain terminal by the data voltage Vcl supplied to the gate terminal of the first TFT T1, whereby the OEL cell may be made to emit light with a brightness corresponding to the data voltage Vcl by way of a voltage difference between the ground voltage source GND and the cell drive voltage source VDD. The second TFT T2 may be configured to form a current mirror with the first TFT T1, thereby uniformly controlling current at the first TFT T1.

The capacitor Cst may store a voltage difference between the data voltage Vcl and the ground voltage source GND to uniformly sustain the voltage supplied to the gate terminal of the first TFT T1 for one frame period, and to uniformly sustain the current supplied to the OEL cell for one frame period. Accordingly, the data driver 66 controlling the pulse width of the current signal in response to the input data may include a plurality of data drive IC's.

Figure 14:
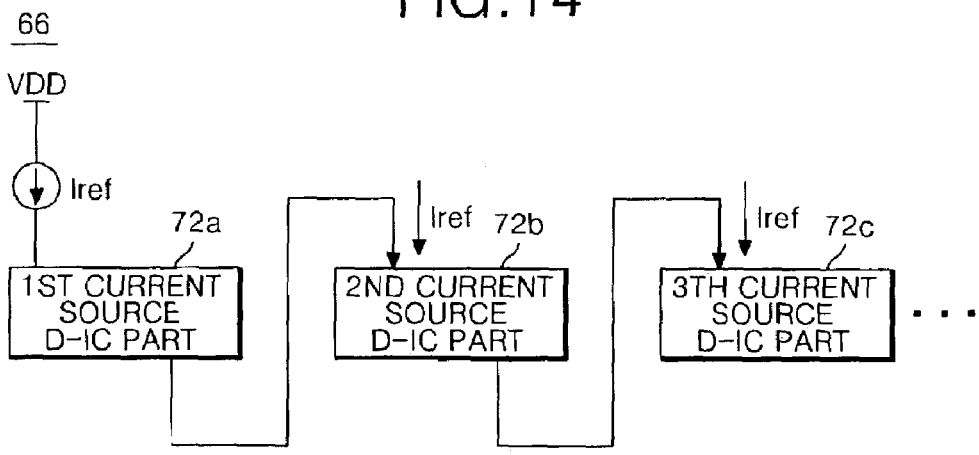
FIG. 14 is a schematic diagram of an exemplary configuration of a data driver according to the present invention.
Figure 15:
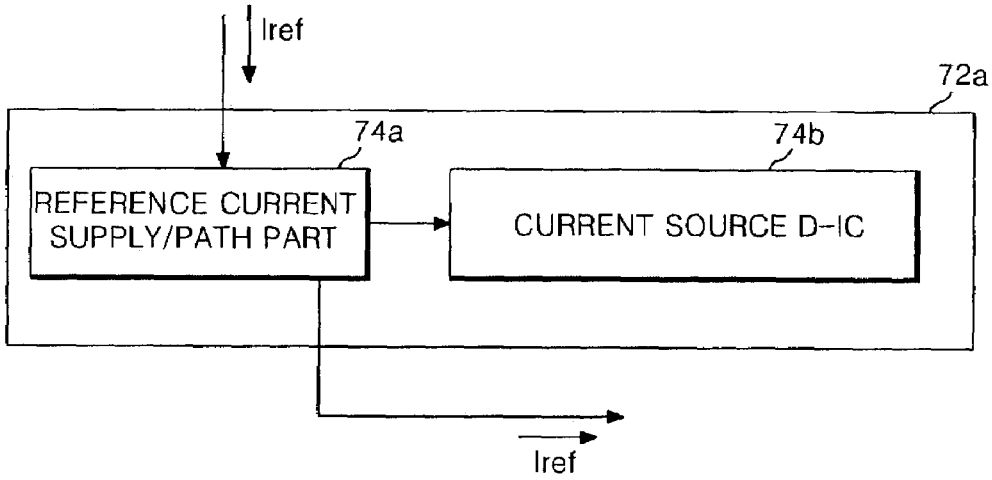
FIG. 15 is a schematic diagram of an exemplary current sink data drive IC part of FIG. 14 according to the present invention.
Figure 16:
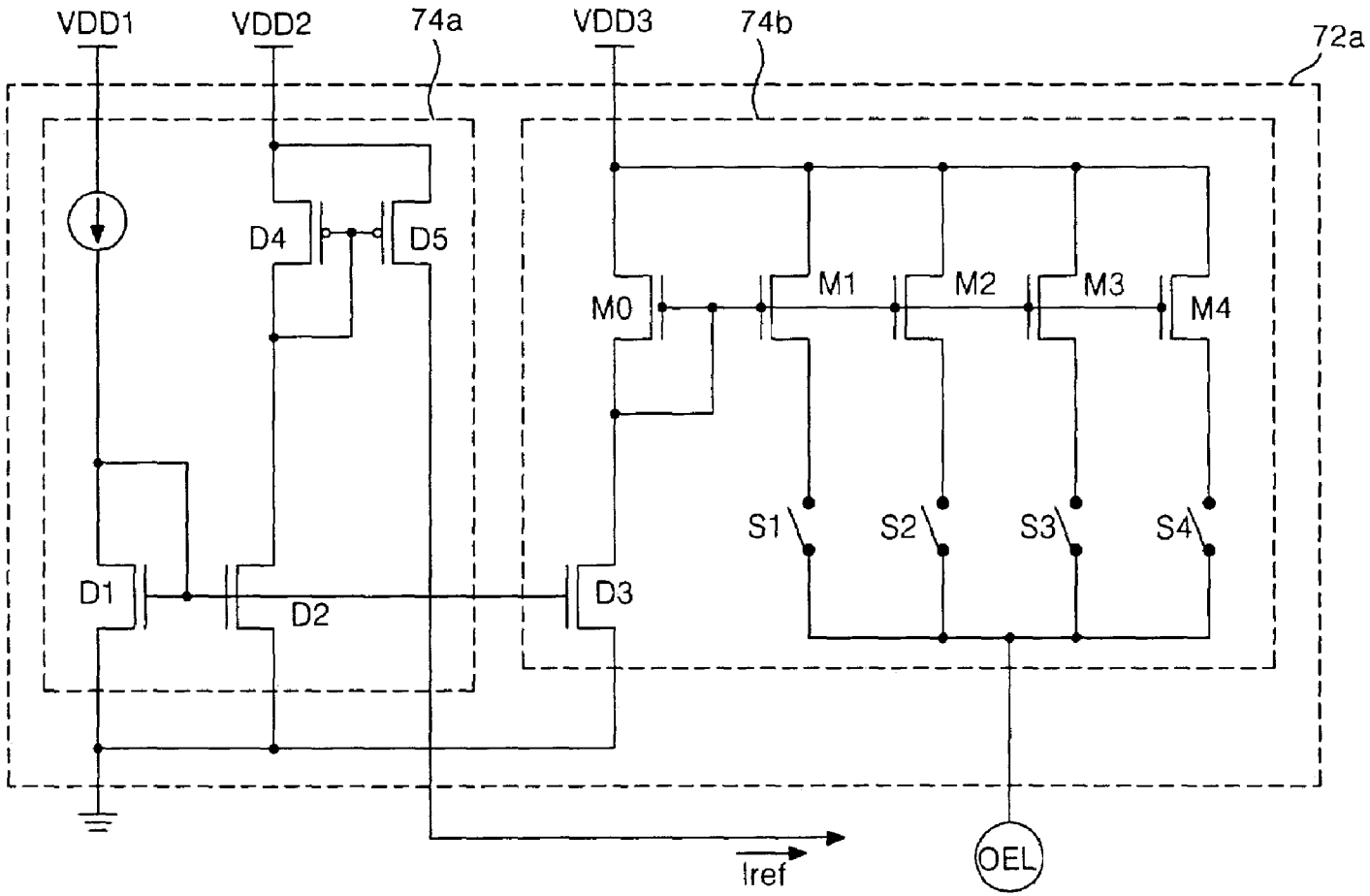
FIG. 16 is a schematic circuit diagram of the current sink data drive IC part of FIG. 14 according to the present invention.

FIG. 14 is a schematic diagram of an exemplary configuration of a data driver according to the present invention, FIG. 15 is a schematic diagram of an exemplary current sink data drive IC part of FIG. 14 according to the present invention, and FIG. 16 is a schematic circuit diagram of the current sink data drive IC part of FIG. 14 according to the present invention. In FIGS. 14 to 16, a data driver 66 may include a plurality of current source data drive IC's 72*a*, 72*b*, 72*c*, . . . , which may be interconnected in a cascade circuit configuration. Each of the current source data drive IC's 72*a*, 72*b*, 72*c*, . . . may include a reference current supply/path part 74*a* and a current source data drive IC 74*b* that may be driven by a reference current from the reference current supply/path part 74*a*, as shown in FIG. 15.

In FIG. 15, the reference current supply/path part 74*a* may receive the reference constant current Iref generated from an exterior voltage source to supply the received current to the current source data drive IC 74*b*. In addition, the reference current supply/path part 74*a* may supply the same reference constant current (i) to an adjacent current source data drive IC part 72*b*.

In FIG. 16, the reference current supply/path part 74*a* may include a first switching device D1 connected between a first voltage source VDD1 and a ground voltage source GND, second and third switching devices D2 and D3 connected to the ground voltage source GND to form a current mirror circuit with the first switching device D1, a fourth switching device D4 connected between the second switching device D2 and a second voltage source VDD2, and a fifth switching device D5 connected to the second voltage source VDD2 to form a current mirror circuit with the fourth switching device D4 and to transmit a reference current to the current source data drive IC part 72*b*. Accordingly, the third switching device D3 may be included within the current source data drive IC 74*b*. The first to third switching devices D1 to D3 may include n-type MOSFETs, and the fourth and fifth switching devices D4 and D5 may include p-type MOSFETs.

During operation, a reference current Iref may flow in the first switching device D1 in accordance with a current source using a first voltage source VDD1, and the same reference current Iref may flow in the second switching device D2 forming the current mirror with the first switching device D1. A current may flow in the fourth switching device D4 connected to the second voltage source VDD2 and the second switching device D2 as much as the reference current Iref may flow through the second switching device D2. The same reference current Iref may flow in the fifth switching device D5 forming the current mirror with the fourth switching device D4, and the current may be supplied to the adjacent current source data drive IC part 72*b*. Accordingly, the same current may be supplied to all current source data drive IC's 74*b* within the data driver 66.

The current source data drive IC 74*b* may include a reference MOSFET M0 connected between a third voltage source VDD3 and the third switching device D3, and constant current sources, i.e., constant current supply MOSFETs M1 to M4, connected in parallel to the reference MOSFET M0 with the third voltage source VDD3 to form a current mirror circuit for supplying a constant current (i) to each data line connected to the OEL cell. Furthermore, the current source data drive IC 74*b* may include switch devices S1 to S4 that may be connected between each of the constant current supply MOSFETs M1 to M4 and the data line to control a supply time of the constant current (i) from the constant current supply MOSFET M1 to M4 in response to input data, thereby controlling the pulse width of the current signal. Accordingly, it may be possible for the current source data drive IC 74*b* not to include the switch devices S1 to S4.

Each of the constant current supply MOSFETs M1 to M4 together with the reference MOSFET M0 receiving the supply voltage of the third voltage source VDD3 in parallel may form a current mirror circuit with the reference MOSFET M0, so the same amount of constant current (i) or $2^n$ times the constant current, i.e., 2*i*, 4*i*, 8*i*, . . . , may be supplied. The constant current (i) supplied from the constant current supply MOSFETs M1 to M4 may change in accordance with the amount of load, i.e., line resistance, of the data lines and a capacitance that is related to the amount of light emission of the OEL cell due to the structure of the ELD panel. Accordingly, the current source data drive IC 74*b* forming a current mirror circuit may include a plurality of current control resistors with a resistance value different from each other at an exterior thereof in order to control the changing current in accordance with the amount of load. In addition, a resistor may be selected among the plurality of current control resistors in accordance with an average amount of load of the current source data drive IC 74*b* to be connected between the reference MOSFET M0 and the ground, thereby controlling the constant current (i) of the current source data drive IC 74*b*.

Figure 17:
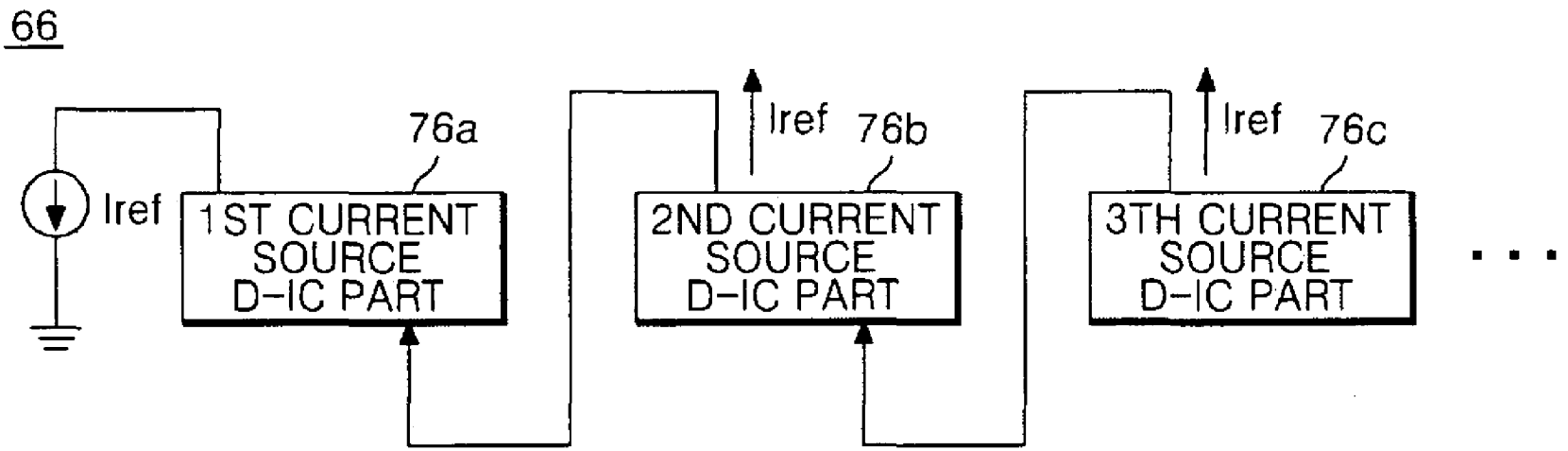
FIG. 17 is a schematic diagram of an exemplary configuration of a data driver according to the present invention.
Figure 18:
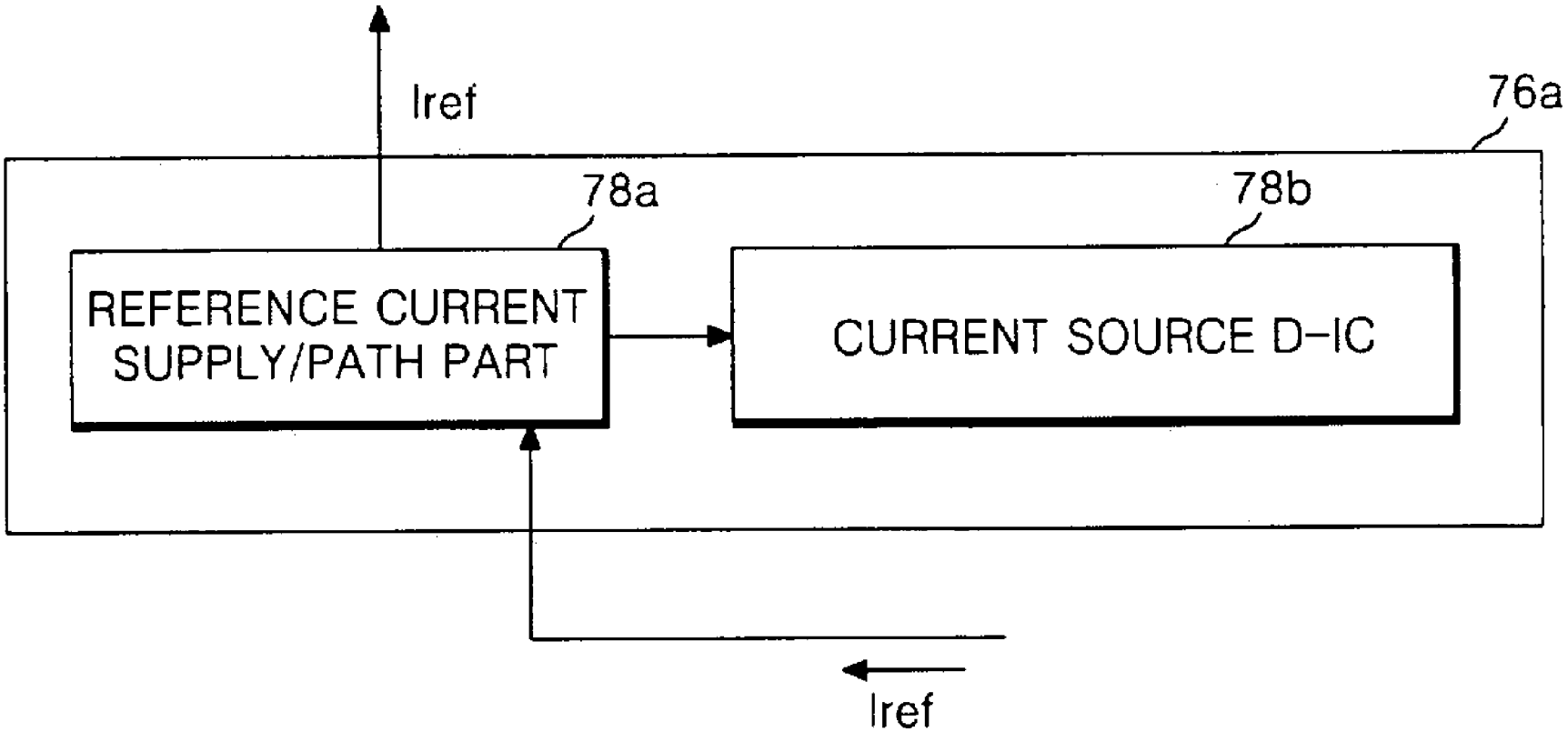
FIG. 18 is a schematic diagram of an exemplary current source data drive IC part of FIG. 17 according to the present invention.
Figure 19:
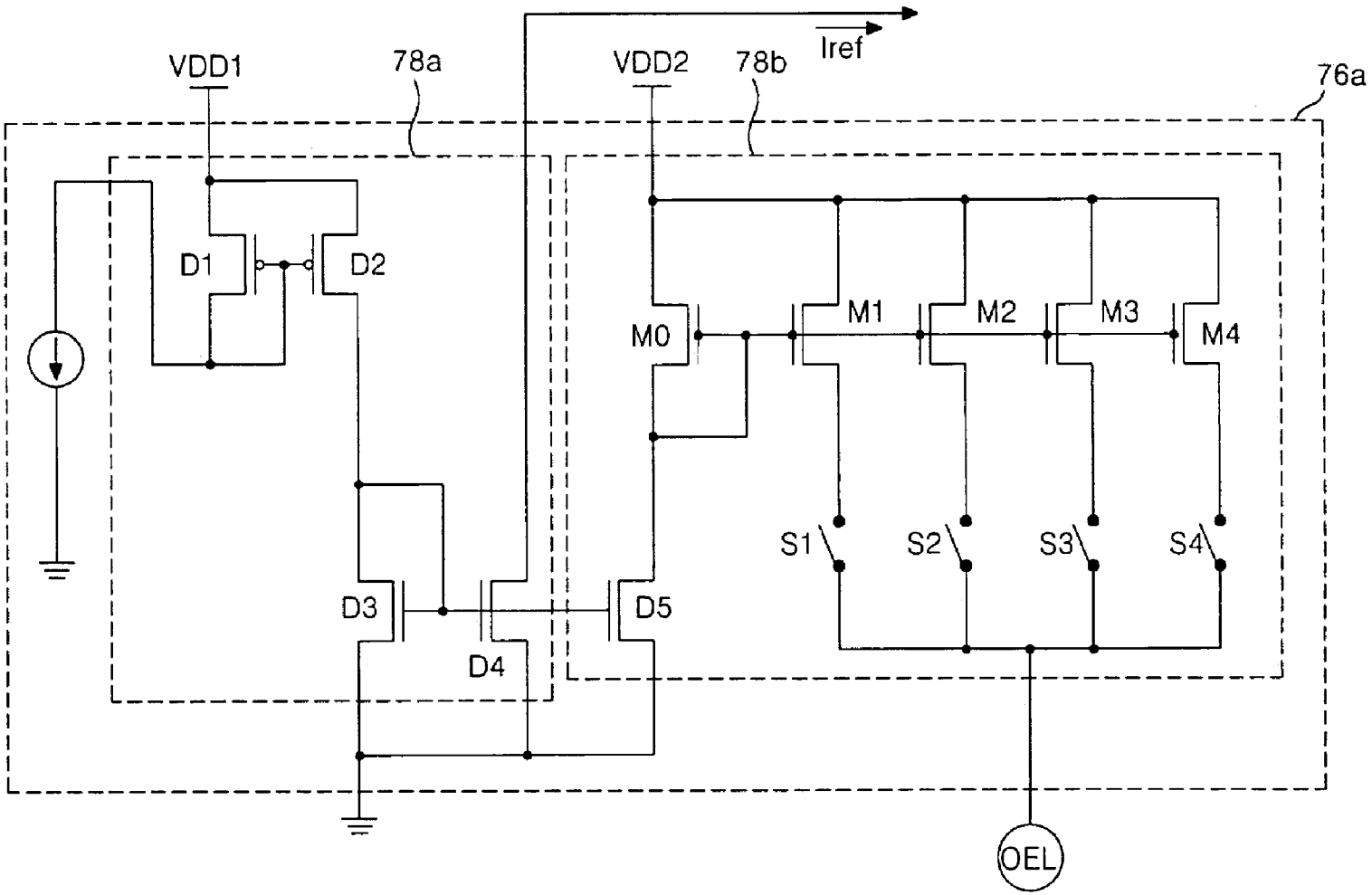
FIG. 19 is a schematic circuit diagram of the current source data drive IC part of FIG. 17 according to: the present invention.

FIG. 17 is a schematic diagram of an exemplary configuration of a data driver according to the present invention, FIG. 18 is a schematic diagram of an exemplary current source data drive IC part of FIG. 17 according to the present invention, and FIG. 19 is a schematic circuit diagram of the current source data drive IC part of FIG. 17 according to the present invention. In FIGS. 17 to 19, a data driver 66 may include a plurality of current source data drive IC's 76*a*, 76*b*, 76*c*, . . . , which may be interconnected in a cascade circuit configuration. Each of the current source data drive IC's 76*a*, 76*b*, 76*c*, . . . may include a reference current supply/path part 78*a* and a current source data drive IC 78*b* that may be driven by a reference current from the reference current supply/path part 78*a*, as shown in FIG. 18.

In FIG. 18, the reference current supply/path part 78*a* may receive the reference constant current Iref generated from the ground voltage source GND to supply the received current to the current source data drive IC 78*b* and may supply the same reference constant current (i) to an adjacent current source data drive IC part 76*b*.

In FIG. 19, the reference current supply/path part 78*a* may include a first switching device D1 connected between a first voltage source VDD1 and a ground voltage source GND, a second switching device D2 connected to the first voltage source VDD1 to form a current mirror circuit with the first switching device D1, a third switching device D3 connected between the second switching device D2 and the ground voltage source GND, a fourth switching device D4 connected to the ground voltage source GND to form a current mirror circuit with the third switching device D3 and to transmit the reference current to the adjacent current source data drive IC part 76B, and a fifth switching device D5 connected to the ground voltage source GND to form a current mirror circuit with the third switching device D3 and to supply the reference current to the current source data drive IC part 78*b*. Accordingly, the fifth switching device D5 may be included within the current source data drive IC 78*b*. The first and second switching devices D1 and D2 may include p-type MOSFETs, and the third to fifth switching devices D3 to D5 may include n-type MOSFETs.

During operation, a reference current Iref may flow through the source-drain terminals of the first switching device D1 in accordance with the pulse width of a current signal using the ground voltage source GND, and the same reference current Iref may flow in the second switching device D2 forming the current mirror with the first switching device D1. The reference current Iref via the second switching device D2 may control the gate terminal of the third switching device D3, thereby causing the same reference current Iref to flow in the third switching device D3. Accordingly, the same reference current Iref may flow in the fourth switching device D4 that forms the current mirror circuit with the third switching device D3, and the same reference current Iref may also flow in the adjacent current source data drive IC 76*b* connected to the fourth switching device D4. The fifth switching device D5 forming the current mirror circuit with the third switching device D3 may supply the reference current Iref into the current source data drive IC 78*b* in the same manner as the third switching device D3. Accordingly, the same current may be supplied to all current source data drive IC's 78*b* within the data driver 66.

In FIG. 19, the current source data drive IC 78*b* may include a reference MOSFET M0 connected between a second voltage source VDD2 and the fifth switching device D5, and constant current sources, i.e., constant current supply MOSFETs M1 to M4, connected in parallel to the reference MOSFET M0 with the second voltage source VDD2 to form a current mirror circuit for supplying a constant current (i) to each data line connected to the OEL cell. Furthermore, the current source data drive IC 78*b* may include switch devices S1 to S4 that may be connected between each of the constant current supply MOSFETs M1 to M4 and the data line to control a supply time of the constant current (i) from the constant current supply MOSFET M1 to M4 in response to input data, thereby controlling the pulse width of the current signal. Accordingly, it may be possible for the current source data drive IC 78*b* not to include the switch devices S1 to S4.

Each of the constant current supply MOSFETs M1 to M4 together with the reference MOSFET M0 receiving the supply voltage of the second voltage source VDD2 in parallel may form a current mirror circuit with the reference MOSFET M0, so the same amount of constant current (i) or $2^n$ times the constant current, i.e., 2*i*, 4*i*, 8*i*, . . . , may be supplied. The constant current (i) supplied from the constant current supply MOSFETs M1 to M4 may change in accordance with the amount of load, i.e., the line resistance, of the data lines and a capacitance that is related to the amount of light emission of the OEL cell due to the structure of the ELD panel. Accordingly, the current source data drive IC 78*b* forming a current mirror circuit may include a plurality of current control resistors with a resistance value different from each other at an exterior thereof in order to control the changing current in accordance with the amount of load. In addition, a resistor may be selected among the plurality of current control resistors in accordance with an average amount of load of the current source data drive IC 78*b* to be connected between the reference MOSFET M0 and the ground, thereby controlling the constant current (i) of the constant current data drive IC 78*b*.

It will be apparent to those skilled in the art that various modifications and variations can be made in the method and apparatus for data-driving an electro-luminescence display panel device of the present invention without departing from the spirit or scope of the invention. Thus, it is intended that the present invention cover the modifications and variations of this invention provided they come within the scope of the appended claims and their equivalents.

What is claimed is:

1. A data-driving apparatus of an electro-luminescence display panel, comprising:

a display panel receiving a current signal to display an image; and a data driver having a plurality of current sink data drive parts in order to supply data to the display panel based on a constant current, at least one of the plurality of current sink data drive parts including a current sink data drive integrated circuit for supplying the data to the display panel based on the constant current, and a reference current supply/path part for supplying the constant current to the current sink data drive integrated circuit and supplying the same constant current to an adjacent current sink data drive part in a cascade circuit configuration, the reference current supply/path part including a first switching device connected between a second voltage source and the ground voltage source, a second switching device connected to the ground voltage source to form a current mirror circuit with the first switching device, a third switching device connected to the ground voltage source to form a current mirror circuit with the first switching device and, in addition, connected to a drain terminal of the constant current switching device of the current sink data drive integrated circuit, a fourth switching device connected between the second switching device and a third voltage source, and a fifth switching device connected to the third voltage source to form a current mirror circuit with the fourth switching device for transmitting the constant current to the adjacent current sink data drive part.

2. The data-driving apparatus according to claim 1, wherein the current sink data drive integrated circuit comprises:

a constant current switching device connected between a voltage source and a ground voltage source; and a plurality of constant current supply switching devices, each connected to the ground voltage source to form a current mirror circuit with the constant current switching device for supplying the constant current to data lines of the panel by way of selecting switch devices corresponding to the constant current controlled at a $2^n$ level through the constant current switching device.

3. The data-driving apparatus according to claim 2, wherein the current sink data drive integrated circuit further comprises:

a plurality of switches connected between the constant current supply switching devices and the data lines for controlling a supply time of the constant current supplied to the data lines to control a pulse width of a current signal.

4. The data-driving apparatus according to claim 2, wherein the constant current switching device and the constant current supply switching device comprise n-type MOSFETs.

5. The data-driving apparatus according to claim 1, wherein the first to third switching devices comprise n-type MOSFETs.

6. The data-driving apparatus according to claim 1, wherein the fourth and fifth switching devices comprise p-type MOSFETs.

7. The data-driving apparatus according to claim 1, wherein the third switching device is integrated with the current sink data drive integrated circuit.

8. A data-driving apparatus of an electro-luminescence display panel, comprising:

a display panel receiving a current signal to display an image; and a data driver having a plurality of current sink data drive parts in order to supply data to the display panel based on a constant current, at least one of the plurality of current sink data drive parts including a current sink data drive integrated circuit for supplying the data to the display panel based on the constant current wherein the current sink data drive integrated circuit includes a constant current switching device connected between a voltage source and a ground voltage source, a plurality of constant current supply switching devices, each connected to the ground voltage source to form a current mirror circuit with the constant current switching device for supplying the constant current to data lines of the panel by way of selecting switch devices corresponding to the constant current controlled at a $2^n$ level through the constant current switching device, and a plurality of switches connected between the constant current supply switching devices and the data lines for controlling a supply time of the constant current supplied to the data lines to control a pulse width of a current signal, and a reference current supply/path part for supplying the constant current to the current sink data drive integrated circuit and supplying the same constant current to an adjacent current sink data drive part in a cascade circuit configuration, the reference current supply/path part including a first switching device connected between a second voltage source and the ground voltage source, a second switching device connected to the second voltage source to form a current mirror circuit with the first switching device, a third switching device connected between the second switching device and the ground voltage source to respond to a current control signal passing through the second switching device, a fourth switching device connected to the ground voltage source to form a current mirror circuit with the third switching device for supplying the constant current to the adjacent current sink data drive part, and a fifth switching device connected to the ground voltage source to form a current mirror circuit with the third switching device and, at the same time, connected to a drain terminal of the constant current switching device of the current sink data drive integrated circuit.

9. The data-driving apparatus according to claim 8, wherein the first and second switching devices comprise p-type MOSFETs.

10. The data-driving apparatus according to claim 8, wherein the third to fifth switching devices comprise n-type MOSFETs.

11. The data-driving apparatus according to claim 8, wherein the fifth switching device is integrated with the current sink data drive integrated circuit.

12. A data-driving apparatus of an electro-luminescence display panel, comprising:

a display panel receiving a current signal to display an image, the display panel including a pixel formed at each intersection part of scan lines and data lines, and the pixel has an electro-luminescence cell and a cell driver, wherein the cell driver includes a first switching device formed between a cell drive voltage source VDD and the electro-luminescence cell for driving the electro-luminescence cell, a second switching device connected to the cell drive voltage source to form a current mirror with the first switching device, an third switching device connected to the second switching device, the scan line and the data line to respond to a signal of the data line, a fourth switching device connected gate terminals of the first and second switching devices, the data line and the third switching device, and a capacitor Cst connected between the cell drive voltage source VDD and the gate terminals of the first and second switching devices; and a data driver having a plurality of current sink data drive parts in order to supply data to the display panel based on a constant current, at least one of the plurality of current sink data drive parts including a current sink data drive integrated circuit for supplying the data to the display panel based on the constant current, and a reference current supply/path part for supplying the constant current to the current sink data drive integrated circuit and supplying the same constant current to an adjacent current sink data drive part in a cascade circuit configuration.

13. A data-driving apparatus of an electro-luminescence display panel, comprising:

a display panel receiving a current signal to display an image; and a data driver having a plurality of current source data drive parts to supply data to the display panel based on a constant current, at least one of the plurality of current source data drive parts including a current source data drive integrated circuit for supplying the data to the display panel based on the constant current, the current source data drive integrated circuit including a constant current switching device connected between a voltage source and a ground voltage source, and a plurality of constant current supply switching devices, each constant current supply switching device connected to the voltage source to form a current mirror circuit with the constant current switching device for supplying the constant current to data lines of the panel by selecting switch devices corresponding to the constant current controlled in a $2^{nd}$ level through the constant current switching device, and a reference current supply/path part for supplying the constant current to the current source data drive integrated circuit and supplying the same constant current to an adjacent current source data drive part in a cascade circuit configuration, the reference current supply/path part including a first switching device connected between a second voltage source and the ground voltage source, a second switching device connected to the ground voltage source to form a current mirror circuit with the first switching device, a third switching device connected to the ground voltage source to form a current mirror circuit with the first switching device and, in addition, connected to a drain terminal of the constant current switching device of the current source data drive integrated circuit, a fourth switching device connected between the second switching device and a third voltage source, and a fifth switching device connected to the third voltage source to form a current mirror circuit with the fourth switching device for transmitting the constant current to the adjacent current source data drive part.

14. The data-driving apparatus according to claim 13, wherein the current source data drive integrated circuit further comprises a plurality of switches connected between the constant current supply switching devices and the data lines for controlling a supply time of the constant current supplied to the data lines to control a pulse width of a current signal.

15. The data-driving apparatus according to claim 13, wherein the constant current switching device and the constant current supply switching device comprise n-type MOSFETs.

16. The data-driving apparatus according to claim 13, wherein the first to third switching devices comprise n-type MOSFETs.

17. The data-driving apparatus according to claim 13, wherein the fourth and fifth switching devices comprise p-type MOSFETs.

18. The data-driving apparatus according to claim 13, wherein the third switching device is integrated with the current source data drive integrated circuit.

19. A data-driving apparatus of an electro-luminescence display panel, comprising:

a display panel receiving a current signal to display an image; and a data driver having a plurality of current source data drive parts to supply data to the display panel based on a constant current, at least one of the plurality of current source data drive parts including a current source data drive integrated circuit for supplying the data to the display panel based on the constant current, the current source data drive integrated circuit including a constant current switching device connected between a voltage source and a ground voltage source, a plurality of constant current supply switching devices, each constant current supply switching device connected to the voltage source to form a current mirror circuit with the constant current switching device for supplying the constant current to data lines of the panel by selecting switch devices corresponding to the constant current controlled in a $2^{nd}$ level through the constant current switching device, and a plurality of switches connected between the constant current supply switching devices and the data lines for controlling a supply time of the constant current supplied to the data lines to control a pulse width of a current signal, and a reference current supply/path part for supplying the constant current to the current source data drive integrated circuit and supplying the same constant current to an adjacent current source data drive part in a cascade circuit configuration, the reference current supply/path part including a first switching device connected between a second voltage source and the ground voltage source, a second switching device connected to the second voltage source to form a current mirror circuit with the first switching device, a third switching device connected between the second switching device and the ground voltage source to respond to a current control signal passing through the second switching device, a fourth switching device connected to the ground voltage source to form a current mirror circuit with the third switching device for supplying the constant current to the adjacent current source data drive part, and a fifth switching device connected to the ground voltage source to form a current mirror circuit with the third switching device and, at the same time, connected to a drain terminal of the constant current switching device of the current source data drive integrated circuit.

20. The data-driving apparatus according to claim 19, wherein the first and second switching devices comprise p-type MOSFETs.

21. The data-driving apparatus according to claim 19, wherein the third to fifth switching devices comprise n-type MOSFETs.

22. The data-driving apparatus according to claim 19, wherein the fifth switching device is integrated with the current sink data drive integrated circuit.

23. A data-driving apparatus of an electro-luminescence display panel, comprising:

a display panel receiving a current signal to display an image, the display panel including a pixel formed at each intersection part of scan lines and data lines, and the pixel has an electro-luminescence cell and a cell driver, wherein the cell driver includes a first switching device formed between a ground voltage source GND and the electro-luminescence cell for driving the electro-luminescence cell, a second switching device connected to the ground voltage source GND to form a current mirror with the first switching device, an third switching device connected to the second switching device, the scan line and the data line to respond to a signal of the data line, a fourth switching device connected gate terminals of the first and second switching devices, the data line and the third switching device, and a capacitor Cst connected between the ground voltage source GND and the gate terminals of the sixth and seventh switching devices; and a data driver having a plurality of current source data drive parts to supply data to the display panel based on a constant current, at least one of the plurality of current source data drive parts including a current source data drive integrated circuit for supplying the data to the display panel based on the constant current, and a reference current supply/path part for supplying the constant current to the current source data drive integrated circuit and supplying the same constant current to an adjacent current source data drive part in a cascade circuit configuration.

* * * * *